United States Patent [19]

Burns

[11] Patent Number: 4,575,141

[45] Date of Patent: Mar. 11, 1986

[54] SAFETY DEAD-BOLT LOCK

[76] Inventor: Michael P. Burns, 2202 Commonwealth Ave., Madison, Wis. 53705

[21] Appl. No.: 549,301

[22] Filed: Nov. 7, 1983

[51] Int. Cl.[4] ..... E05C 13/00

[52] U.S. Cl. ..... 292/336.3; 70/214; 292/347

[58] Field of Search ..... 292/DIG. 2, 336.3, 347, 292/DIG. 37; 74/553, 558, 558.5; 70/214

[56] References Cited

U.S. PATENT DOCUMENTS

| | | | |
|---|---|---|---|
| 793,087 | 6/1905 | McVitty | 70/214 |
| 1,705,340 | 3/1929 | Robert | 70/214 |
| 2,000,111 | 5/1935 | Weis | 70/214 |

FOREIGN PATENT DOCUMENTS

| | | | |
|---|---|---|---|
| 502799 | 4/1976 | U.S.S.R. | 70/214 |

*Primary Examiner*—Richard E. Moore

*Attorney, Agent, or Firm*—Isaksen, Lathrop, Esch, Hart & Clark

[57] ABSTRACT

A safety dead-bolt lock adapted to be mounted on a door. The safety dead-bolt lock has a bolt and a rotatable bolt activator. A safety knob is adapted to rotate the bolt activator and thus extend and withdraw the bolt. The safety knob has a rotatable member engaged with the bolt activator and a stationary member adapted to be fixed to the door. A disengageable interlocking mechanism is adapted to prevent rotation of the rotatable member relative to the stationary member. Depressable tabs mounted in the rotatable member disengage the interlocking mechanism when depressed, allowing the rotatable member to be turned to withdraw and extend the bolt. The tabs are in such an arrangement and are so oriented that they are conveniently presented toward the hand of a user located on the side of the door on which the stationary member is mounted, but the hand of a person reaching from the other side of the door cannot readily assume the position necessary to depress the tabs.

16 Claims, 4 Drawing Figures

SAFETY DEAD-BOLT LOCK

TECHNICAL FIELD

The present invention relates to locks for doors in general and, in particular, to dead-bolt locks adapted to resist operation by intruders.

BACKGROUND OF ART

Doors equipped with dead bolts generally have a finger- or hand-manipulatable inside knob, allowing a user of the lock to unlock the door from inside without recourse to a key. It is important to be able to do this both for general convenience and because in such an emergency as a fire it may be necessary for an occupant of a house or room to exit through a door in the midst of darkness, smoke, and confusion that prevents the ready finding and use of a key.

When a door having such a lock in it has sidelites generally adjacent to the lock or has a window lite in the door itself within reaching distance of the lock, an intruder can gain entrance through the door by breaking the glass, reaching inside, and opening the lock by manipulation of the interior knob. Such doors are no more secure than the window the provides access to the lock. If a door has a strong frame with relatively weak panels or the like, a portion of the door itself may be broken through to provide access from the outside to the knob.

The art is cognizant of various methods for attempting to secure a door lock against such an assault. Ferrer, U.S. Pat. No. 3,563,069, teaches the use of a box-like structure that completely covers the doorknob associated with the lock on the interior side of a door. The cover is padlocked, making the doorknob inaccessible to someone breaking through a sidelite. Crockett, U.S. Pat. No. 4,227,386 is another example of the use of a cover over a lock assembly to prevent access thereto. Ferrer requires the use of a key to open the protective cover as a necessary first step to unlocking the door. Consequently, the system of securing the lock in Ferrer is no more convenient to a user than the lock of Hennesey, U.S. Pat. No. 4,272,974 or Shipman, U.S. Pat. No. 3,964,281, both of which provide for conventional keyed cylinders on both sides of a door.

Push button locks are generally known in the art. Examples include Check, U.S. Pat. No. 3,099,150, and Hartman, U.S. Pat. No. 4,014,194. The push buttons in Hartman remain fixed relative to the door as they are used. In Check the buttons are mounted in a knob. When the push buttons are appropriately depressed, activating a complicated rachet system that releases the knob, the knob can be turned to withdraw a bolt. In either case, nothing in the design of these push button locks prevents their operation by a person who has broken a window lite in or beside the door and is manipulating the lock, having thrust his arm through the broken window lite. In addition, a combination must be known to open the locks, which are intended to substitute for a conventional keyed cylinder on the exterior side of a door.

BRIEF SUMMARY OF THE INVENTION

The present invention is summarized in that a safety dead-bolt lock adapted to be mounted on a door includes a bolt adapted to extend and move longitudinally within the door, a rotatable bolt activator engaged with the bolt and adapted to be accessible from a selected side of the door, the bolt activator being adapted to extend and withdraw the bolt upon selected rotation of the bolt activator, and a safety knob adapted to rotate the bolt activator. The safety knob has a rotatable member so engaged with the bolt activator as to be able to rotate it and adapted to be rotated by the hand of a user to rotate the bolt activator and thus withdraw and extend the bolt. The safety knob includes a stationary member adapted to be fixed to the door and to receive the rotatable member in rotating relation. A disengageable interlocking mechanism is adapted to prevent the rotation of the rotatable member relative to the stationary member. The safety knob also includes depressable tabs adapted to disengage the interlocking mechanism when the tabs are depressed, allowing the rotatable member to be rotated relative to the stationary member to extend and withdraw the bolt, the tabs being in such an arrangement and so oriented that they are conveniently presented toward the hand of a user located on the side of the door on which the stationary member is mounted but that the hand of a person reaching from the other side of the door cannot readily assume the position necessary to depress the tabs.

A primary object of the invention is to provide a safety dead-bolt lock having an interior knob easily manipulated by a person standing on the inside side of a door but not readily manipulatable through a broken window lite or other, comparable opening by a person standing outside of the door.

A second object of the invention is to provide a safety dead-bolt lock having such characteristics that also is relatively simple in design to facilitate reliable operation and easy manufacture.

Another object of the invention is to provide such a safety dead-bolt lock that does not require the use of a key or knowledge of a combination.

Yet another object of the invention is to provide a safety knob usable with existing dead-bolt locks to convert them into safety dead-bolt locks having the advantages mentioned above.

Other objects, features, and advantages of the invention will be apparent from the following detailed description taken in conjunction with the accompanying drawings showing a preferred embodiment of a safety dead-bolt lock exemplifying the principles of the invention.

DETAILED DESCRIPTION OF THE PREFERRED EMBODIMENT

Figure 1:
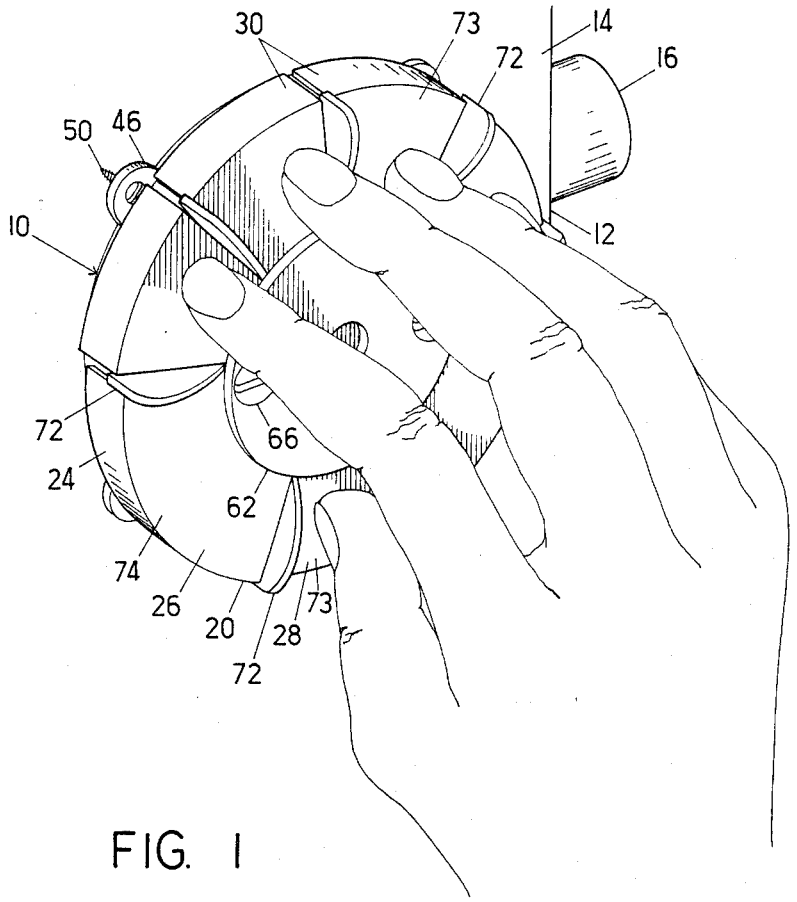
FIG. 1 is a perspective view of a safety dead-bolt lock with the hand of a user in place over the finger tabs thereof.
Figure 2:
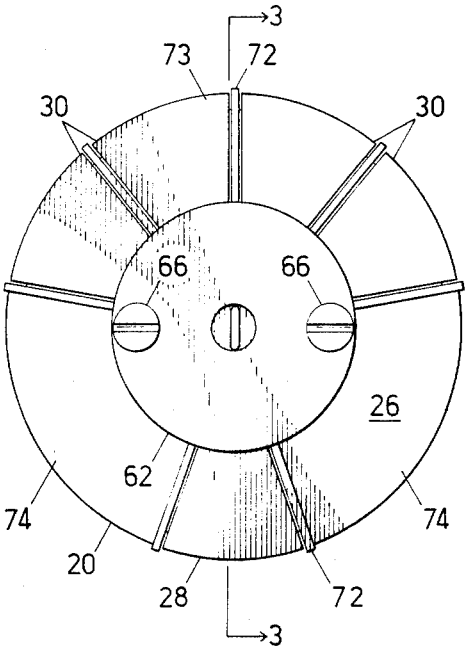
FIG. 2 is a view of the interior side of the safety dead-bolt lock of FIG. 1.
Figure 3:
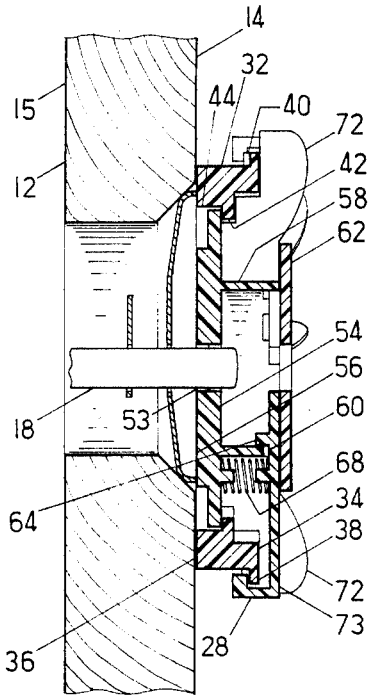
FIG. 3 is a cross-sectional view of the device of FIG. 2 taken along section line 3—3 and mounted on a door.
Figure 4:
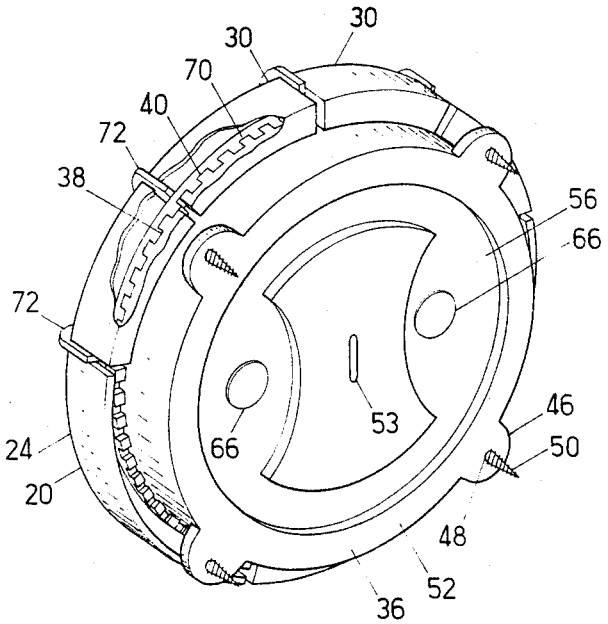
FIG. 4 is a perspective view of the safety knob attachment of the safety dead-bolt lock of FIG. 1 from the back, with parts thereof broken away.

Referring more particularly to the drawings, wherein like numbers refer to like parts, FIG. 1 shows a safety dead-bolt lock, generally indicated at 10, made in accord with the present invention. The safety dead-bolt lock 10 is adapted to be mounted on a door 12. Solely for purposes of convenience of description, it will be presumed that the door 12 has an interior side 14 and an exterior side 15 and that the user of the dead-bolt lock 10 desires to operate it from the interior side.

The dead-bolt lock 10 has a generally conventional bolt 16 adapted to extend and move longitudinally within the door 12, generally parallel to the interior side 14 thereof. A rotatable bolt activator 18 extends from the bolt 16 toward the interior side 14 and is adapted to extend or withdraw the bolt upon selected rotation of the bolt activator. The bolt activator 18 is engaged with the bolt 16 by a suitable, conventional linkage (not shown) adapted to convert the rotational motion of the bolt activator into linear motion of the bolt.

A safety knob 20 is adapted to be attached to the interior side 14 of the door 12 and is adapted to rotate the bolt activator 18. In the preferred embodiment, the safety knob 20 has a stationary undercase 22 rigidly attached to the door 12. A turnable overcase 24 generally covers the undercase and is adapted to be turned by finger manipulation. The overcase 24 is connected to the bolt activator 18 by an appropriate linkage, so that turning the overcase rotates the bolt actuator, which in turn extends and withdraws the bolt 16.

The overcase 24 and undercase 22 have a cooperating, disengageable, interlocking mechanism adapted to prevent relative movement between the overcase and undercase. The overcase 24 has a generally planar, non-depressable face 26 adapted to be generally parallel to the interior side 14 of the door 12 when the safety knob 20 is mounted thereon. The overcase 24 also has a thumb tab 28 and a selected number of finger tabs 30 depressably mounted in the face 26 of the overcase. The thumb tab 28 and finger tabs 30 are so arranged that a user's thumb and fingers are generally opposed to each other when in place on the tabs, as is illustrated in FIG. 1. The thumb and finger tabs 28, 30 are so oriented that the thumb tab is generally downwardmost and preferably is at the bottom of the overcase 24 and under the finger tabs when the bolt 16 is extended.

The undercase 22 has a generally circular body 32 and has a front and a back side 34, 36. An annular ring 38 extends outwardly at the periphery of the body 32 at a selected distance from the back side 36. The ring 38 has downwardly extending, teeth 40, preferably square in profile. The body 32 has a central opening 42 extending between the front side 34 and back side 36. Surfaces of the body 32 facing toward the central opening 42 and back side 36 define a circular race 44. Fastener tabs 46 extend from the body 32 at its periphery for a selected distance and have holes 48 extending therethrough in a direction generally parallel to the central axis of the body. The body 32 may be fastened to the door 12 by such means for fastening as the wood screws shown at 50 extending through the holes 48 of the fastener tabs 46.

The turnable overcase 24 has a disk-shaped base 52 adapted to turn freely in the circular race 44 of the undercase 22. The base 52 has front and back sides 54, 56 corresponding in orientation to the front and back sides 34, 36 of the undercase body 32. A tube 58 extends from the front side 54 of the base 52 to a point beyond the front side 34 of the undercase body 32. The tube 58 is co-axial with the disk-shaped base 52. The disk-shaped base 52 has means to engage the rotatable bolt activator 18. In the preferred embodiment, the bolt activator 18 is a bar that must be twisted to move the bolt 16, and the means for engaging it is a slot 53 formed in the center of the disk-shaped base 52.

The thumb and finger tabs 28, 30 substantially correspond in structure in all regards. Each such tab 28, 30 extends from a point within the tube 58 outwardly beyond the annular ring 38 at the periphery of the undercase body 32. The top edge of the tube 58 has notches 60, one notch corresponding in location to that of each of the tabs 28, 30. Each notch is adapted to receive a tab 28, 30 and has a depth such that the top surface of the tab received therein is flush with the top edge of the tube. A cover plate 62 is fastened over the top of the tube 58, confining each tab 28, 30 in its notch 60. Each tab 28, 30 has a retention member 64 that prevents the tab from being pulled free of the notch 60 once the cover plate 62 is in place. Preferably, the cover plate 62 is held over the end of the tube 58 by fasteners that extend through the cover plate and on through the disk-shaped base 52, such as the bolts shown at 66. As a consequence of this arrangement, each tab 28, 30 turns on the edge of the tube 58 like a lever on its axis. A compression spring 68 extends between the underside of each tab 28, 30 and the front side 54 of the base 52 at a point between the tube 58 and the periphery of the overcase 22, to urge the tab away from the base.

Each tab 28, 30 extends outwardly over the annular ring 38 of the undercase body 32, then backwardly beyond the annular ring, and then toward the undercase body, hooking under the annular ring. Each tab has frontwardly opening teeth-engaging notches 70 adapted to fit over and engage the backwardly extending teeth 40 of the annular ring 38, being forced into interlocking relation therewith by the pressure exerted by the spring 68. Tab separators 72 are rigidly attached to the disk-shaped base 52 and tube 58. The tab separators 72 extend at either side of each tab 28, 30, defining channels to restrain their lateral movement. Each tab has a frontwardly facing pressing surface 73 against which the finger of a user may press to depress the tab. Preferably the tab separators extend frontwardly at least to the pressing surface 73 to constitute a tab housing, adapted to prevent depression of the tab by any object wider than the tab. Preferably the tab separators extend beyond the face 26 of the turnable overcase 24. Space fillers 74 define a part of the face 26 and are likewise rigidly attached to the base 52 and tube 58 and extend from the tube outwardly to the periphery of the turnable overcase 24. Preferably the space fillers 74 are flat and are generally co-planar with the tabs 28, 30, when the tabs are not depressed.

In its use, the safety dead-bolt lock of the invention is first installed in a door in the manner apparent from the figures and the disclosure above. It will be noted that, when the backwardly extending teeth 40 are engaged in the teeth-engaging notches 70, the turnable overcase 24 is secured and cannot be turned with respect to the undercase 22. A user of the safety dead-bolt lock 10 can free the overcase for turning only by depressing simultaneously the thumb tab 28 and all of the finger tabs 30. With the teeth-engaging notches 70 thus pushed free of the teeth 40, the overcase 24 can be turned, and bolt 16 may thereby be extended and withdrawn. The tab separator 72 provide useful surfaces against which the sides of the fingers and thumb of the user may push in turning the overcase 24.

It will be appreciated that, with the thumb tab 28 oriented in a generally downward direction with respect to the opposing finger tabs 30, the hand of a user is forced to assume a particular position in order to depress the tabs and allow the bolt 16 to be withdrawn or extended. This position is such that it is easy to assume by a person standing before the door 12 on its interior side 14. However, it is extremely difficult and almost impossible for a person to properly orient his fingers and thumb in a like manner when he is extending his hand from the exterior side 15 of the door 12 through an opening such as a sidelite that is located to one side of the safety knob 20. To do so would require a rotation of the wrist and elbow beyond the normal limits of those joints. Furthermore, a person attempting to open the door through a sidelite from the outside could not simply depress the entire surface of the face 26, thereby incidentally depressing the tabs 28, 30. Any such attempt would be frustrated by the rigidity of the tab separators 72 and space fillers 74. Even a rigid appliance of some sort adapted to be placed over the face 26 and to apply pressure only to the tabs 28, 30 could be frustrated by arbitrarily making one or more of the finger tabs 30 a rigid structure without notches 60, comparable to the space fillers 74. A person attempting to gain access from the outside would have to know the exact configuration of depressable tabs 20, 30, as opposed to undepressable surfaces, that any given safety knob 20 presented.

All rigid parts of the embodiment disclosed may be made of any suitably strong material, such as metal and plastic. The parts may be made by molding, machining, and other conventional means for working such materials.

Although the embodiment disclosed above is the preferred embodiment of the invention, it is apparent that other embodiments of a safety dead-bolt lock 10 having a functionally equivalent safety knob structure are possible and are within the scope and spirit of the invention. In addition, a safety knob 20 may be manufactured separately for installation on preexisting locks to convert them to the safety dead-bolt lock structure disclosed. Any safety knob structure wherein a rotatable member such as the turnable overcase 24 is adapted to turn and thus withdraw and extend a bolt is within the scope and spirit of the invention if the rotatable member is prevented from so rotating by an interlocking mechanism between the rotatable member and some other stationary member, such as the stationary undercase 22, until the interlocking mechanism is disengaged by depression of tabs or equivalent structures adapted to be pressed by the fingers and thumb of a user, such tabs being so oriented that the hand of a person standing on the exterior side of the door equipped with the safety knob cannot readily assume the position necessary to depress the tabs. Although described as a door-mounted dead-bolt lock, it will be apparent that the lock and safety knob 20 of the invention may be utilized as a knob operated lock of any sort. Thus, it is understood that the present invention is not limited to the particular construction and arrangement of parts illustrated and disclosed. Instead, it embraces all such modified forms thereof as come within the scope of the following claims.

What is claimed is:

1. A safety dead-bolt lock adapted to be mounted on a door comprising:

(a) a dead-bolt including a bolt adapted to extend to move longitudinally within the door and a rotatable bolt activator operatively connected to the bolt to extend and withdraw the bolt upon selective rotation of the bolt activator; and (b) a safety knob adapted to be mounted to the door having:

(1) a stationary member adapted to be affixed to the door;

(2) a rotatable member mounted for rotation to the stationary member and exposed to allow it to be grasped and rotated by the hand of the user, the rotatable member engaged with the bolt activator to rotate it as the rotatable member rotates;

(3) interlocking means, having engaged and disengaged positions, for preventing rotation of the rotatable member relative to the stationary member when in its engaged position and permitting rotation of the rotatable member when in its disengaged position;

(4) a plurality of depressable tabs mounted to the rotatable member for movement inwardly toward the door when pressed by the fingers of a user and biased to return outwardly toward the user when the user's fingers release the tabs, the tabs being operatively connected to the interlocking means such that depression of the tabs by the user moves the interlocking means from its engaged position to its disengaged position thereby allowing the user to turn the rotatable member, and wherein release of the tabs by the fingers of a user such that the tabs return to their undepressed position causes the interlocking means to move to its engaged position preventing rotation of the rotatable member with respect to the stationary member.

2. The safety dead-bolt lock of claim 1 wherein each tab has a pressing surface against which the finger of a user may press to depress the tab and the rotatable member has a face generally co-planar with the pressing surfaces of the tabs when the tabs are not depressed, whereby the tabs must be depressed below the face to cause the interlocking means to be moved to its disengaged position.

3. The safety dead-bolt lock of claim 2 further including tab housings fastened to the rotatable member which are raised above the face of the rotatable member and located at least on one side of each tab, thereby inhibiting the depressing of any tab by any object wider than the tab.

4. The safety dead-bolt lock of claim 2 wherein the tabs include tabs for each of a user's thumb and four fingers arranged generally about the periphery of the rotatable member and in which the thumb tab and finger tabs are arranged such that the thumb tab is generally opposite to the positions of the finger tabs with respect to the center of rotation of the rotatable member.

5. The safety dead-bolt lock of claim 1 in which the stationary member includes a generally circular undercase which is adapted to be attached to the door and wherein the rotatable member has a generally circular overcase which covers the undercase, the overcase being engaged with the bolt activator to turn it as the overcase turns, the interlocking means locking the overcase and undercase together when in its engaged position and releasing the overcase from the undercase in its disengaged position to allow relative movement of the overcase with respect to the undercase.

6. The safety dead-bolt lock of claim 5 wherein the stationary undercase has a front side and a back side and wherein the interlocking means includes an annular ring extending about the periphery of the undercase and raised a selected distance above the back side of the undercase, the annular ring having teeth extending about the periphery thereof toward the door, the thumb and finger tabs having portions thereof extending beyond the annular ring with teeth engaging notches therein which engage with teeth of the annular ring when the tabs are in their undepressed positions and wherein the teeth engaging notches are disengaged from the teeth on the annular ring when the tabs are depressed by the fingers of a user.

7. The safety dead-bolt lock of claim 5 wherein at least one of the finger tabs is rigidly mounted to the overcase.

8. A safety knob adapted to be used with a dead-bolt lock of the type having a bolt and a rotatable bolt activator engaged with the bolt to drive it from an inward to an outward position upon rotation of the bolt activator, with the bolt activator being accessible from one side of the door, the safety knob comprising:

(a) a stationary member adapted to be affixed to the door;

(b) a rotatable member mounted for rotation to the stationary member and exposed to allow it to be grasped and rotated by the hand of the user, the rotatable member engaged with the bolt activator to rotate it as the rotatable member rotates;

(c) interlocking means, having engaged and disengaged positions, for preventing rotation of the rotatable member relative to the stationary member when in its engaged position and permitting rotation of the rotatable member when in its disengaged position;

(d) a plurality of depressable tabs mounted to the rotatable member for movement inwardly toward the door when pressed by the fingers of a user and biased to return outwardly toward the user when the user's fingers release the tabs, the tabs being operatively connected to the interlocking means such that depression of the tabs by the user moves the interlocking means from its engaged position to its disengaged position thereby allowing the user to turn the rotatable member, and wherein release of the tabs by the fingers of a user such that the tabs return to their undepressed position causes the interlocking means to move to its engaged position preventing rotation of the rotatable member with respect to the stationary member.

9. The safety knob of claim 8 wherein each tab has a pressing surface against which the finger of a user may press to depress the tab and the rotatable member has a face generally co-planar with the pressing surfaces of the tabs when the tabs are not depressed, whereby the tabs must be depressed below the face to cause the interlocking means to be moved to its disengaged position.

10. The safety knob of claim 9 further including tab housings fastened to the rotatable member which are raised above the face of the rotatable member and located at least on one side of each tab, thereby inhibiting depression of any tab by any object than the tab.

11. The safety knob of claim 9 wherein the tabs include tabs for each of a user's thumb and four fingers arranged generally about the periphery of the rotatable member and in which the thumb tab and finger tabs are arranged such that the thumb tab is generally opposite to the position of the finger tabs with respect to the center of rotation of the rotatable member.

12. The safety knob of claim 8 in which the stationary member includes a generally circular undercase which is adapted to be attached to the door and wherein the rotatable member has a generally circular overcase which covers the undercase, the overcase being engaged with the bolt activator to turn it as the overcase turns, the interlocking means locking the overcase and undercase together when in its engaged position and releasing the overcase from the undercase in its disengaged position to allow relative movement of the overcase with respect to the undercase.

13. The safety knob of claim 12 wherein the stationary undercase has a front side and a back side and wherein the interlocking means includes an annular ring extending about the periphery of the undercase and raised a selected distance above the back side of the undercase, the annular ring having teeth extending about the periphery thereof toward the door, the thumb and finger tabs having portions thereof extending beyond the annular ring with teeth engaging notches therein which engage with teeth of the annular ring when the tabs are in their undepressed positions and wherein the teeth engaging notches are disengaged from the teeth on the annular ring when the tabs are depressed by the fingers of a user.

14. The safety knob of claim 12 wherein at least one of the finger tabs is rigidly mounted to the overcase.

15. A safety knob adapted to be mounted to a dead-bolt lock set having a rotatable bolt activator, comprising:

(a) a generally circular stationary member adapted to be mounted to a door having an open central portion and an annular ring extending from the periphery of the stationary member and having teeth formed thereon extending downwardly toward the position of a door when the stationary member is mounted to the door;

(b) a generally circular rotatable member mounted to the stationary member for rotation and adapted to be engaged to the bolt activator to rotate the same as the rotatable member rotates, the rotatable member having a plurality of finger tabs spring biased to an outward position and having portions thereon that extend over the annular ring on the stationary member and extend beneath it and have upwardly facing teeth engaging notches thereon that are adapted to mate and engage with the downwardly extending teeth on the annular ring portion of the stationary member, the rotatable member also having separator portions thereof which extend between the depressible tabs to separate the same and which extend outwardly at least as high as the tops of the tab to prevent an object spanning the separators to depress two or more tabs at once, whereby, when the tabs are in their outwardly biased position, the notches on the extending portions of the tabs will engage with the teeth on the annular ring portion of the stationary member, thereby preventing relative rotation of the rotatable member with respect to the stationary member, and whereby when the tabs are depressed by the fingers of a user to move the tabs downwardly a distance sufficient that the notches on the tabs clear the teeth on the stationary member, the rotatable member can be rotated with respect to the stationary member and thereby rotate a bolt activator engaged to the rotatable member.

16. The safety knob of claim 15 wherein portions of the tab separators extend outwardly above the position of the top surfaces of the tabs when in their outwardly biased positions for a significant distance thereby to make it more difficult for a person to depress more than one tab at a time with a single finger.

* * * * *